United States Patent [19]

Lindstrom

[11] 4,360,378

[45] Nov. 23, 1982

[54] DIRECT REDUCTION OF IRON OXIDE CONTAINING MATERIAL WITH BIOFUEL

[76] Inventor: Olle B. Lindstrom, Lorensviksvägen 14, S-183 63 Täby, Sweden

[21] Appl. No.: 201,394

[22] PCT Filed: Feb. 29, 1980

[86] PCT No.: PCT/SE80/00058

§ 371 Date: Oct. 29, 1980

§ 102(e) Date: Oct. 29, 1980

[87] PCT Pub. No.: WO80/01808

PCT Pub. Date: Sep. 4, 1980

[30] Foreign Application Priority Data

Mar. 1, 1979 [SE] Sweden ..... 7901867

[51] Int. Cl.[3] ..... C21B 13/06

[52] U.S. Cl. ..... 75/34; 75/26; 75/36

[58] Field of Search ..... 75/33–38, 75/26

[56] References Cited

U.S. PATENT DOCUMENTS

| | | | |
|---|---|---|---|
| 2,014,873 | 9/1935 | Wildman | 75/33 |
| 2,864,686 | 12/1958 | Agarwal | 75/3 |

FOREIGN PATENT DOCUMENTS

| | | | |
|---|---|---|---|
| 1259048 | 3/1961 | France | 75/33 |
| 1021474 | 3/1966 | United Kingdom | 75/33 |
| 1506170 | 4/1978 | United Kingdom | 75/33 |
| 1521499 | 8/1978 | United Kingdom | 75/33 |

OTHER PUBLICATIONS

Sandviken Handbook pp. 20 and 29.

*Primary Examiner*—M. J. Andrews
*Attorney, Agent, or Firm*—Burns, Doane, Swecker & Mathis

[57] ABSTRACT

A new method is devised for the production of raw iron or so-called metallized iron ore. Biofuels i.e. preferably fuel wood and/or peat is in the final reduction brought into direct contact with the iron containing material in its solid state. Biofuels have very different properties compared to reduction agents on the basis of fossil fuels primarily coal and develop rapidly a reactive reduction gas at a comparatively low temperature. The new raw iron process is carried out with the iron containing material in its solid state of aggregation in different kinds of fluidized bed reactors in different system configurations.

17 Claims, 4 Drawing Figures

DIRECT REDUCTION OF IRON OXIDE CONTAINING MATERIAL WITH BIOFUEL

Strong efforts are made today for the development of methods for the production of raw iron or so-called metallized iron ore. The raw iron can be converted further in direct connection with the reduction process or be shipped as raw material for further conversion at steel mills at other locations. Such processes are described e.g. in the Swedish patent publications Nos. 363161, 384225 and 387366.

In these known processes the reduction is carried out at a temperature which is lower than the melting point of the iron and the iron containing material as well as the reduction agent are present in a finely divided state. The reduction agent is a fossil fuel, e.g. anthracite, coal, lignite, oil natural gas, etc. These fuels coke to a varying degree to solid carbon containing material which is present in intimate mixture with the iron containing material.

These known processes are carried out in several steps in different process systems containing rotating furnaces, fluidized beds, etc. The Swedish patent publication No. 384225 describes e.g. a procedure which relies on so-called circulating fluidized beds.

The Swedish patent publication No. 395017 describes another method for the production of a prereduced product whereby the iron containing material is reduced while it is falling through a shaft whereby the material is melted.

Quite generally a raw iron process should meet the following requirements among others:

(1) The degree of reduction should be high, preferably exceeding about 90–95%.

(2) The reduction agent should not deliver impurities to the raw iron which then have to be eliminated.

(3) As much of the reduction agent as possible should be utilized for reduction work.

(4) The raw iron should have suitable properties for subsequent processing, in particular a large specific surface, good general properties for materials handling, small tendency for reoxidation, etc.

(5) The process system should contain as few system parts as possible to cut down the capital investment and improve the reliability of the operation.

(6) The reduction agent should be generally available at predictable costs in order to insure operation of the process system during its physical life.

The temperature is a key parameter for the different raw iron processes, another key parameter is the composition of the reduction gas in different steps of the process. The major problem with processes which operate with the material in its solid state of aggregation the whole time is the so-called cladding which easily takes place at temperatures above 700°–750° C. Lower temperatures give a lower reduction velocity as is well known. The equilibria for the different process steps are also strongly influenced by the temperature and is described in the Swedish patent publication No. 222512.

The rate of the reduction process in particular the final reduction to metallic iron depends on the particle size of the iron containing material as well as on the reactivity of the reduction agent. The so far preferred fossil fuels, in first hand cheap dust coal, require comparatively high temperatures for sufficiently fast pyrolysis and gasification reactions, which generate the reducing gases which then react with the iron containing material.

The present invention relies on a reduction fuel that has been of limited application in this connection, i.e. biofuel, in a new way. The invention seems to satisfy very well the requirements that have been claimed above. In several of the cases, e.g. the requirement (6), this is a consequence of the property of this fuel to be renewable and available all over the world. The advantages of the new raw iron process and its surprising effects can be derived from the utilization and the special properties of the biofuel which characterizes this invention. The invention thus comprises a procedure for the reduction of iron containing material in a finely divided state in three steps which may be continuously following each other or running simultaneously, i.e. preheat, prereduction and final reduction which is characterized thereby that the final reduction is carried out with biofuels which are brought into direct contact with the iron oxide containing material in its solid state.

Figure 1:
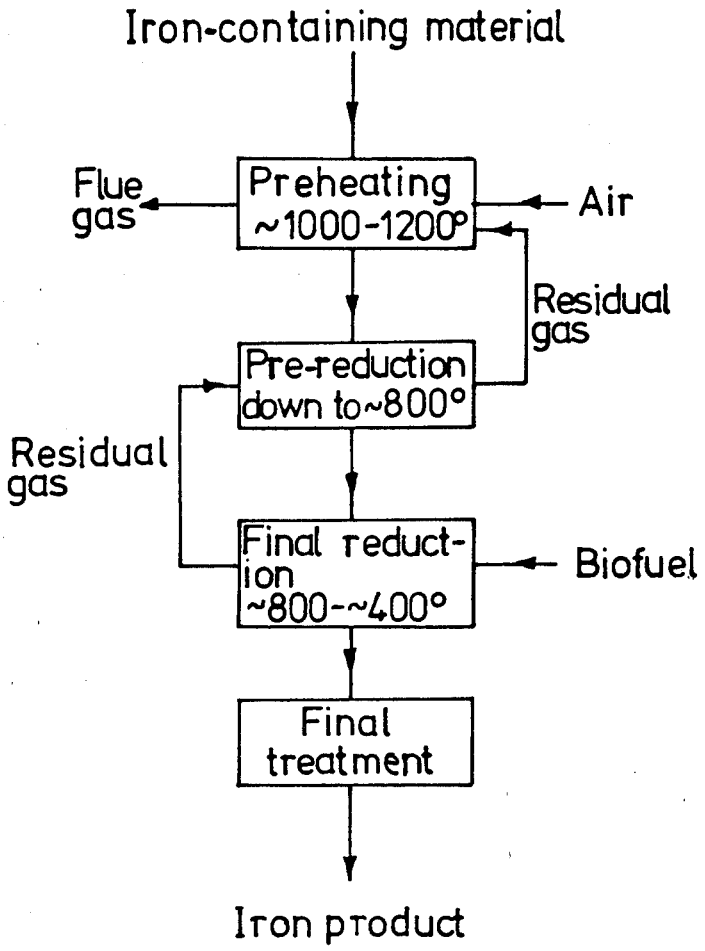
FIG. 1 shows in a form of a block diagram the principle for the invention.

The purpose with FIG. 1 is to show in principle the spirit of the invention and how different embodiments may be derived from the invention.

FIG. 1 shows schematically three different steps which follow each other i.e. a preheat step, a reduction step, and a final reduction step possibly followed by final treatment. The different steps can each involve several partial steps. The steps can be carried out in a continuous sequence in one and the same reactor e.g. with the material falling freely in a furnace shaft. They can also be carried out in different units (reactors or reactor parts) with transport of the solid iron containing material between these units. The steps can also be carried out one after the other in one and the same batch reactor in the form of a fluidized bed.

The novelty of the invention which is a common feature for all these variations is that biofuel is added to the final reduction step whereby the iron containing material is reduced from preferably ferrous state to metallic iron. The biofuels react extraordinarily fast during the pyrolysis which produces very reactive, reducing gases and a highly reactive pyrolysis residue, so-called char. This pyrolysis residue frequently amounts to a much smaller proportion of the added fuel charge during the exceedingly fast pyrolysis which takes place already at temperatures in the range 300°–400° C. compared to what is the case with the known fossil fuels which are today being used for the raw iron processes. These known fossil fuels have a much higher thermal stability than the reactive biofuels.

Thanks to the more reactive reduction gas the reduction process can also be carried out at a lower temperature at a sufficient, rate whereby the so-called cladding problem is avoided. The small quantities of remaining char also seem to be a particularly efficient agent for inhibition of cladding.

It is frequently desired, particularly when the final reduction is carried out in temperatures in the range 600°–800° C. or below that, to recirculate part of the gas to the final reduction as is shown schematically in FIG. 1.

A major part (sometimes the whole) of the heat requirement for the pre- and final reduction can be satisfied by strong preheating of the iron containing material in the preceding steps which is preferably done by combustion of the residual reduction gas from the prereduction. Pyrolysis and gasification reactions are in general also requiring energy, which energy requirement can be satisfied in this way. A major advantage with the biofuels is, however, that this energy requirement is quite small, there are even indications that the thermochemical process may be exothermic with biomass.

It may sometimes be of advantage with a partial combustion of the biofuel and its reaction products in the final reduction while still maintaining the gas composition which is required for the reaction which is described e.g. in the Swedish patent publication No. 198401.

The specific measures discussed above are easily decided by the artisan and determined by the properties of the iron containing material, like its chemical composition, particle size, reactivity, and of course the desired degree of metallization, method for final treatment, etc.

It is frequently desired to make use as much as possible of the energy content of the reduction agent in the form of chemical energy in the process itself by balancing the different process flows with direct and indirect heat exchange when this is possible and desirable.

The final treatment, indicated in FIG. 1, may comprise many different moments from inactivation of the very reactive, pyrophoric products of raw iron which are produced during reduction at low temperature of finely divided iron ore concentrates to melting in an electric furnace for subsequent refining in direct connection to the raw iron process.

The key explanation that the procedure according to the invention so effectively meets the requirements of an optimal raw iron process is given by the different process chemistry of the biofuels compared to the fossil fuels. It has been shown that the thermochemical reaction pattern of the biofuels very well fits the reaction pattern for the reduction of finely divided iron oxides.

Biofuel here means mainly phyto-biomass which is obtained as a raw material from e.g. energy plantations, i.e. fast growing sallow and poplar plantations, or in the form of wood energy i.e. waste from the forestry like wood and bark wastes from the production of paper and pulp. Straw from agriculture and kelp from kelp plantations also belong to this category. In countries with warmer climate there are many different kinds of fuel crops which are produced in a large quantity counted on the area and to low cost. Energy forestry for Swedish conditions is described in the publication Energiskog, Institutionen för Kemisk Teknologi, Kungl. Tekniska Högskolan, Stockholm, 1978. Table 1 shows the large differences in the chemical analysis of the biofuels compared to fossil fuel, in this case coal.

TABLE 1

Elementary analysis for different reduction agents, weight - %.

| | C | O | H | N | S |
|---|---|---|---|---|---|
| Straw | 46.2 | 42.0 | 6.0 | 2.6 | 0.14 |
| Bark | 47.2 | 39.3 | 5.6 | 0.4 | 0.07 |
| Wood of poplar | 49.8 | 44.4 | 5.9 | 0.6 | 0.04 |
| Peat (Von Post 3–4) | 52.4 | 36.1 | 5.3 | 1.0 | 0.1 |
| Coal | 79.7 | 11.4 | 5.2 | 1.5 | 0.2 |

The biomass has a high oxygen content which probably is the explanation to its high reactivity at low temperatures. Peat is fairly near to the biomass with respect to chemical analysis and thermochemical reactivity. Peat is therefore here counted as a biofuel and not as a fossil fuel. (A peat bog is furthermore growing continuously). It has thus been found that the procedure according to the invention may be carried out with biofuel in the form of peat even if the preferred biofuel consists of newly harvested energy forest, etc. It is also possible to mix different kinds of biofuels when this is feasible, e.g. raw material from energy forestry and peat.

Native biomass has a high water content which should be reduced as much as possible prior to the utilization according to the invention. The moisture content should preferably be taken down to about 30% by weight of water or below to make possible an efficient and balanced utilization of the biomass in the reduction processes. Drying may easily be done by means of chip dryers or in other ways by use of excess heat from the process. The amount of steam formed during the reduction processes is anyhow sufficient for partial gasification of char produced in the pyrolysis.

Figure 2:
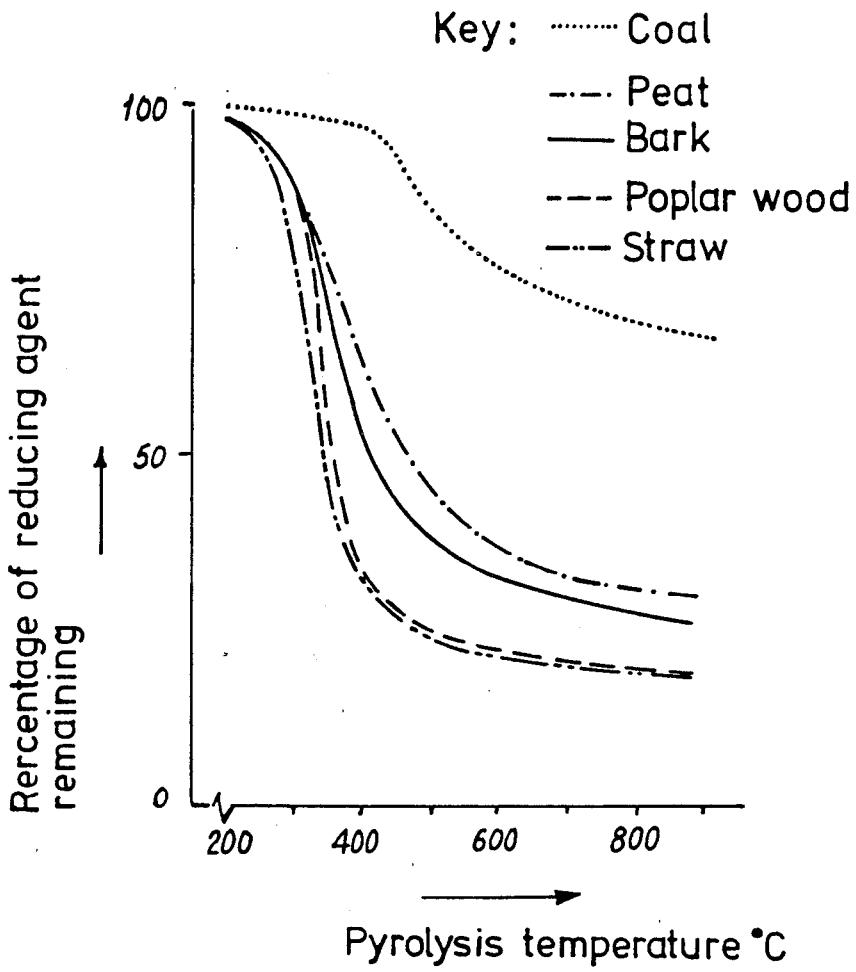
FIG. 2 shows the process of pyrolysis with biofuels.
Figure 3:
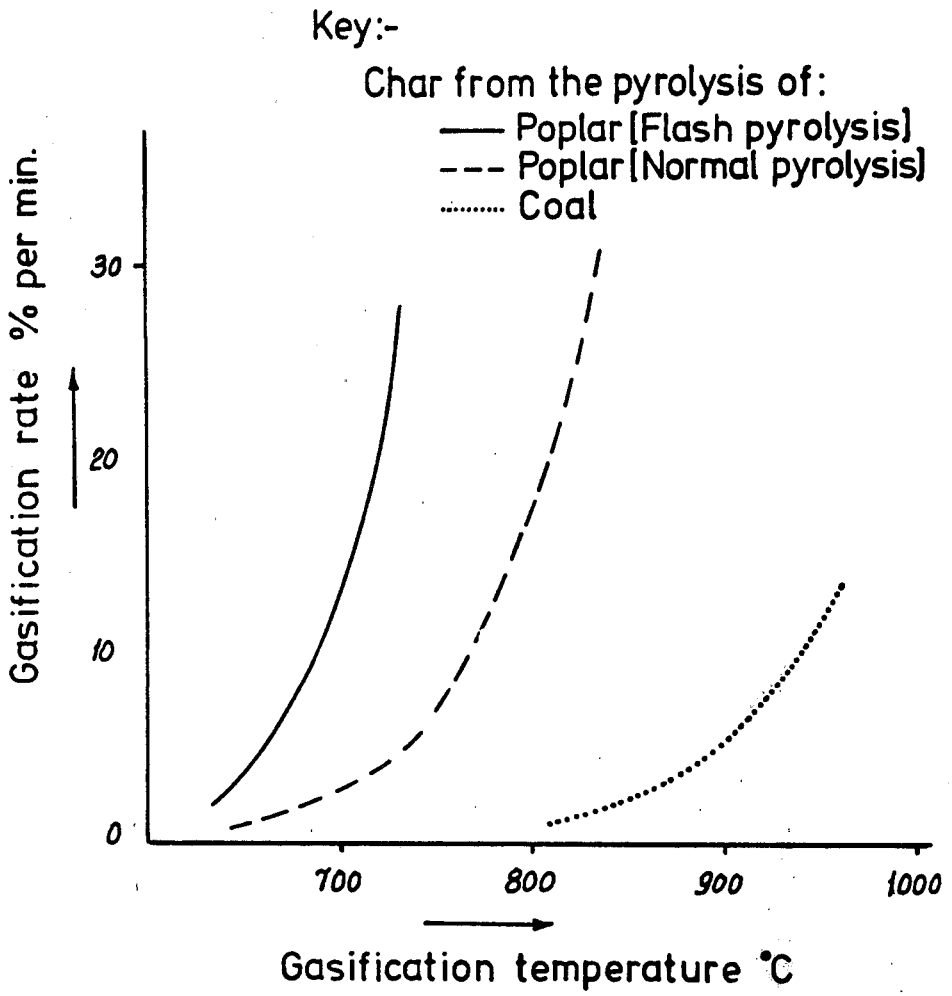
FIG. 3 shows gasification of pyrolysis residue.

FIG. 2 and FIG. 3 demonstrate the different process chemistry of the biofuels compared to the solid fossil fuels. FIG. 2 shows the process of so-called flash pyrolysis i.e. very rapid heating of the kind which occurs during the procedure according to the invention in the direct contact between the hot iron containing material and the biofuel in the final reduction step. The figure shows how biomass and also peat belong to a special category on its own compared to coal. FIG. 3 shows the exceedingly high reactivity during the gasification step, i.e. the reaction between in particular water vapor and the active char from flash pyrolysis. These properties constitute the essential foundation for the new raw iron process.

The iron containing material consists of finely divided iron containing ore like siderite ($FeCO_3$), magnetite ($Fe_3O_4$), hematite ($Fe_2O_3$), etc. The siderite contains the iron in its ferrous state whereby the prereduction is replaced by a step of calcination for the removal of the carbon dioxide. Also other iron containing material may be converted to raw iron with advantage according to the procedure of the invention, e.g. purple ore or other finely divided iron oxide containing waste products like dust and chips from blast furnaces, steel and rolling plants.

Different additives may be used in the subsequent refining processes e.g. oxides or carbonates of alkaline earth metals which furthermore also contribute to prevention of cladding during the final reduction.

The particle size of the iron containing material should be less than about 5 mm when the processes are carried out in conventional fluidized beds and should be less than about 0.5 mm with so-called fast or circulating fluidized beds. The particles of the biofuel should be larger than the particles of the iron containing material frequently 2–3 times larger from which follows that the particles frequently have a size in the range of about 0.5 mm to several centimeters. It is thus possible to use wood chip with conventional fluidized beds whereas finely divided ground wood powder with a particle size of about 1 mm should be used with circulating beds or for reduction of extremely finely divided iron containing material, e.g. ball milled iron ore concentrate. The fast reduction processes which characterize the invention are of course promoted if the iron containing material as well as the biomass is present in a finely divided state.

Commercially available iron ore concentrate e.g. concentrate of iron ore from the mines in Kiruna and Malmberget, Sweden, particularly suited for the procedure according to the invention without special pretreatment. It has, however, been possible to carry out the final reduction at very low temperatures in the range 400°-600° C. by further ball milling of the iron ore concentrate down to particle sizes of the order of 10 μm or even below whereby the final reduction goes directly to metallic iron without passing intermediately the two valenced state. The possibility to carry out the final reduction at such a low temperature is solely dependent on the special thermochemical properties of these fuels as has been described above.

Extremely finely divided raw iron powder may in certain cases be used directly for metallurgical processes like the production of porous iron electrodes for accumulators of different kind.

Direct use of the raw iron manufactured according to the procedures of the invention of course necessitates that the iron raw material has such a chemical composition with respect to other metals and elements, e.g. sulphur, that these may either be tolerated in the finished product or may be eliminated by choice of suitable reaction conditions. Char accompanying the powder of the raw iron in the cases of these extreme embodiments of the invention may either be separated by magnetic separators which separate the iron or may remain in the product for different purposes e.g. to serve as a spacer in the manufacture of sintered porous iron products.

Figure 4:
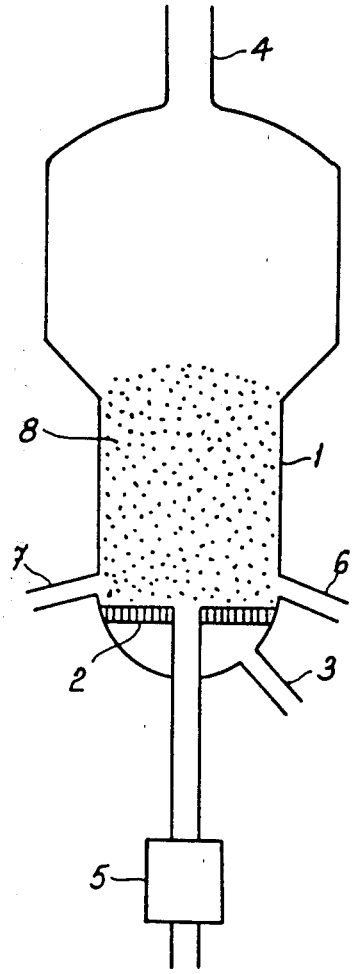
FIG. 4 shows a suitable process system for the procedure according to the invention.

FIG. 4 shows such a simplest possible reactor for the procedure according to the invention with one single classical fluidized bed in which the reduction is carried out batch-wise.—Different types of fluidized beds are described in Chem. Eng. Progress (1971:2)58-63.—The bed consists of a reactor room (1) furnished with a gas distributing plate (2), supply pipe for gas (3), discharge pipe for gas (4), feeding means for biofuel (5) and charge and discharge means for iron containing material (6), respectively (7). The fluidized bed (8) is fluidized by means of gas supply through the pipe (3) and/or gas which is developed by the biofuel during the final reduction. The fluidized bed is for its function depending on a large number of additional components which are not shown like valves, connection pipes, dust separators, indicators for process control, heat exchangers, charging means for supporting fuel, and possibly air and/or oxygen addition, etc. All this is known technology and need not be mentioned in this description.

The first moment of course is to add a charge of the iron containing powder which is then preheated to a temperature in the range of about 1000°-1200° C., with hot combustion gases which are generated by combustion of reduction gas being discharged from a second similar reactor which is in the prereduction stage. This second reactor in its turn gets its reduction gas from a third reactor involved in the final reduction stage. The prereduction in the said second reactor is starting at the preheat temperature in the range about 1000°-1200° C. and is then decreasing to about 800° C. when it is time to start the final reduction in this reactor by feeding biofuel whereby the temperature successively decreases further to the level 600° C.

Suitable conditions for fluidization are maintained by recirculation of reduction gas and control of the feeding of the biofuel. Additional heat for temperature control is obtained by supply of air and/or oxygen. It is also possible to remove carbon dioxide and water in the known way prior to recirculation of the reduction gas.

It is of course of great advantage to operate with more than three reactors, respectively three modes of operation. Use of e.g. three reactors coupled in series in the preheat stage makes it possible to operate on three different temperature ranges in the three reactors in a way that the last reactor in the series is heated by exhaust gas from the reactor before etc. which makes it possible to decrease the temperature of the exhaust gas leaving the system to an average level of about 200° C.

It is, of course, not a long wayfrom the charge-wise operation that has been indicated above to a continuous mode of operation with different reactors and reactor parts for the different stages whereby the iron containing material is transferred from one reactor or reactor part to the next one.

Another simple mode of operation is to run two fluidized beds joined in series continuously. One fluidized bed is then taking care of the preheating and is operating constantly at a temperature about 1100°-1200° C. by combustion of exhaust gas. Preheated iron oxide containing material is leaving continuously from the preheat bed in which pre- and final reduction occur simultaneously. This reduction bed is operating around 700° C. Biofuel is fed directly into the bed as well as recirculation gas and possibly air and/or oxygen. Leaving reduced material may in this way go directly for refining, pressing to pieces of raw iron etc. according to the actual circumstances and requirements. The energy in the hot exhaust gas from the preheat bed is taken care of in the known way in a boiler for production of electric power, steam and hot water.

The reaction times can be shortened considerably if the pre- and final reduction steps are carried out under pressure, e.g. in the range of 0.5-2 MPa. The principle of the batch reactor is particularly suitable for reduction under pressure. Pressurizing also permits a faster feeding of the biofuel. The feeding rate is frequently limited at atmospheric pressure by the necessity to limit the gas velocity for optimal fluidization.

Reaction times required and consequently the size of the beds depend of course of a large number of factors from particle size to operation pressure and temperature. There are no data available in the literature for dimensioning these reactors. Laboratory experiments on a small scale show that processing times of about 1 hour or below may be maintained at temperatures around 800° C. for the final reduction. The consumption of biofuel of course depends on the process design. Operation with one single fluidized bed at 800° C. with simultaneous heat supply (by partial oxidation), pre- and final reduction requires in one case two tons of biofuel per ton product (90%). The major part of the biofuel energy supplied in this way is in this case recovered in the exhaust gas containing about 8 GJ/Nm$^3$ which is leaving the system and must be taken care of e.g. for power production. Processes designed for a maximum utilization of the biofuel energy in the process system itself may require down to 0.5 ton biofuel/ton product.

The description above has relied on process systems with classical fluidized beds in different combinations. This depends mainly on the fact that these simple reactors seem to be quite satisfactory for the procedure according to the invention, particularly for pressurized processes. The procedure may however also be used with other reactor types as circulating fluidized beds etc. There is no difficulty for the artisan to choose and design suitable process systems for every special type of raw material and given requirements with respect to product properties, efficiency, etc.

I claim:

1. A method for the reduction of an iron oxide-containing material comprising:

(a) preheating an iron oxide-containing material in a preheating zone;

(b) passing said preheated iron oxide-containing material to a first reduction zone wherein said material is contacted with a reducing gas under suitable conditions of temperature and pressure to partially reduce said iron oxide in said material;

(c) passing said material to a second reduction zone wherein said iron oxide is contacted with a finely divided biofuel selected from the group consisting of wood, wood waste, straw, kelp and peat under suitable conditions of temperature and pressure and further reduced while producing a reducing gas, said reducing gas being passed to said first reduction zone; and (d) recovering the reduced material from said second reduction zone.

2. The method of claim 1 wherein said iron oxide-containing material is preheated by means of combustion of a fuel in said preheating zone.

3. The method of claim 2 wherein residual gas from said first reduction zone is passed to said preheating zone and combusted in the presence of air to preheat said iron oxide-containing material.

4. The method of claim 1 wherein said biofuel is dried to reduce the moisture content thereof.

5. The method of claim 4 wherein said biofuel is dried to reduce the moisture content thereof to below about 30 percent by weight.

6. The method of claim 1 wherein said iron oxide-containing material is preheated to between about 1000° and 1200° C. in said preheating zone.

7. The method of claim 1 wherein the temperature of said first reduction zone ranges from about 1200° to about 800° C.

8. The method of claim 1 wherein the temperature of said second reduction zone ranges from about 800° to 400° C.

9. The method of claim 1 wherein each of said zones comprises a fluidized bed.

10. The method of claim 1 wherein at least said preheating and second reduction zones are pressurized.

11. The method of claim 9 wherein said iron oxide-containing material is of a size of about 0.5 millimeter in maximum dimension.

12. The method of claim 8 wherein the temperature of said second reduction zone ranges from about 400° to 600° C.

13. The method of claim 1 wherein said iron oxide-containing material is of a size of about 5 millimeters in maximum dimension.

14. The method of claim 1 wherein said finely divided biofuel is at least 0.5 millimeter in maximum dimension.

15. The method of claim 1 wherein said method is carried out batch-wise in a single fluidized bed in which the iron oxide-containing material is successively passed through preheat, first reduction and second reduction steps.

16. The method of claim 1 wherein each of said zones comprises a different fluidized bed which is operating simultaneously with respect to one another.

17. The method of claim 1 wherein said iron oxide-containing material is ground to a particle size of about 0.01 millimeter.

* * * * *